United States Patent [19]

Webb

[11] 4,192,149

[45] Mar. 11, 1980

[54] POST CONDENSER LOOP CASE HEATER CONTROLLED BY AMBIENT HUMIDITY

[75] Inventor: William M. Webb, Louisville, Ky.

[73] Assignee: General Electric Company, Louisville, Ky.

[21] Appl. No.: 943,607

[22] Filed: Sep. 18, 1978

[51] Int. Cl.[2] ..... F25D 21/06

[52] U.S. Cl. ..... 62/151; 62/176 A; 62/273; 62/277

[58] Field of Search ..... 62/167 A, 273, 277, 62/196 B, 238 E, 324 D

[56] References Cited

U.S. PATENT DOCUMENTS

| | | | |
|---|---|---|---|
| 2,135,091 | 11/1938 | Newill | 62/89 |
| 2,390,808 | 12/1945 | Newman | 62/116 |
| 3,157,306 | 11/1964 | Courson | 62/277 X |
| 3,518,841 | 7/1970 | West, Jr. | 62/153 |
| 3,572,051 | 4/1971 | Benasutti | 62/277 |
| 3,835,660 | 9/1974 | Franck | 62/277 |
| 3,859,502 | 1/1975 | Heaney | 219/218 |
| 3,905,202 | 9/1975 | Taft et al. | 62/152 |
| 3,939,666 | 2/1976 | Bashak | 62/150 |
| 3,984,223 | 10/1976 | Whistler, Jr. | 62/81 |

*Primary Examiner*—William E. Wayner
*Assistant Examiner*—Harry Tanner
*Attorney, Agent, or Firm*—Frank P. Giacalone; Frederick P. Weidner; Radford M. Reams

[57] ABSTRACT

A refrigerator cabinet having a chamber divided by a mullion into a freezer and fresh food compartment, each having a front door open. Arranged in the mullion and front door opening of the freezer is auxiliary liquid line loop arrangement whichprevents condensation from forming on the freezer front door openings. A valve is provided in the auxiliary line arrangement for controlling flow through the auxiliary liquid line in response to the ambient relative humidity conditions.

9 Claims, 3 Drawing Figures

POST CONDENSER LOOP CASE HEATER CONTROLLED BY AMBIENT HUMIDITY

BACKGROUND OF THE INVENTION

This invention relates to a multi-compartment refrigerator divided into a freezer and fresh food compartment, each having front door openings and more particular to a system for minimizing the formation of condensation around the openings where heat leakage reduces exterior temperatures slightly below ambient.

In many prior art attempts at controlling condensation, a portion of the refrigeration system liquid line has been employed around the cabinet door openings such as U.S. Pat. Nos. 2,135,091-Newill; 3,572,051-Benasutti; and 3,984,223-Whistler, Jr. In applying the approach as a means for controlling condensation, the liquid line is transferred to the cabinet whenever the refrigeration system is operating. This practice is not efficient in that heat is needed only when the ambient humidity is so high that the reduced cabinet temperatures around the door openings are below the dew point, causing moisture to condense on these surfaces. The constant application of heat causes some of the heat from the liquid line to be transferred into the compartments and, accordingly, the refrigeration system must run for longer periods of time to overcome this heat source. In other prior art attempts, electric heaters are employed which consume a relatively large amount of energy. To improve the efficiency of these electric heaters, switches have been employed which allow the user of the apparatus to manually de-energize the heaters when desired, such as under low ambient humidity conditions. Other attempts at improving efficiency of electric heaters are taught in U.S. Pat. Nos. 3,859,502-Heaney and 3,939,666-Bashark in that energization of the heaters is automatically controlled. In any instance, the employment of heaters for controlling condensation requires additional use of energy independent of the refrigeration system.

SUMMARY OF THE INVENTION

A multi-compartment refrigeration cabinet includes a chamber that is divided by a mullion into a freezer and fresh food compartment with each having a front door opening. A refrigeration system arranged in the cabinet includes a compressor, a condenser, an expansion device and an evaporator in series relationship, with the condenser being connected to the expansion device by a liquid refrigerant flow line. An auxiliary liquid line is connected in bypass relationship to the liquid flow line. The auxiliary is connected into the liquid flow line in bypass relation between the condenser and the expansion device. The auxiliary liquid line has a first portion that is arranged in heat exchange relationship with the mullion and a second portion arranged in heat exchange relationship relative to the freezer front door opening.

A valve is arranged in the liquid line in parallel flow relation with the auxiliary liquid line for controlling flow through the auxiliary liquid line. A control means including ambient relative humidity sensing means is provided for causing flow through the auxiliary line when the ambient relative humidity exceeds a predetermined level so that the freezer front door opening is heated to control condensation.

DESCRIPTION OF THE PREFERRED EMBODIMENT

Figure 1:
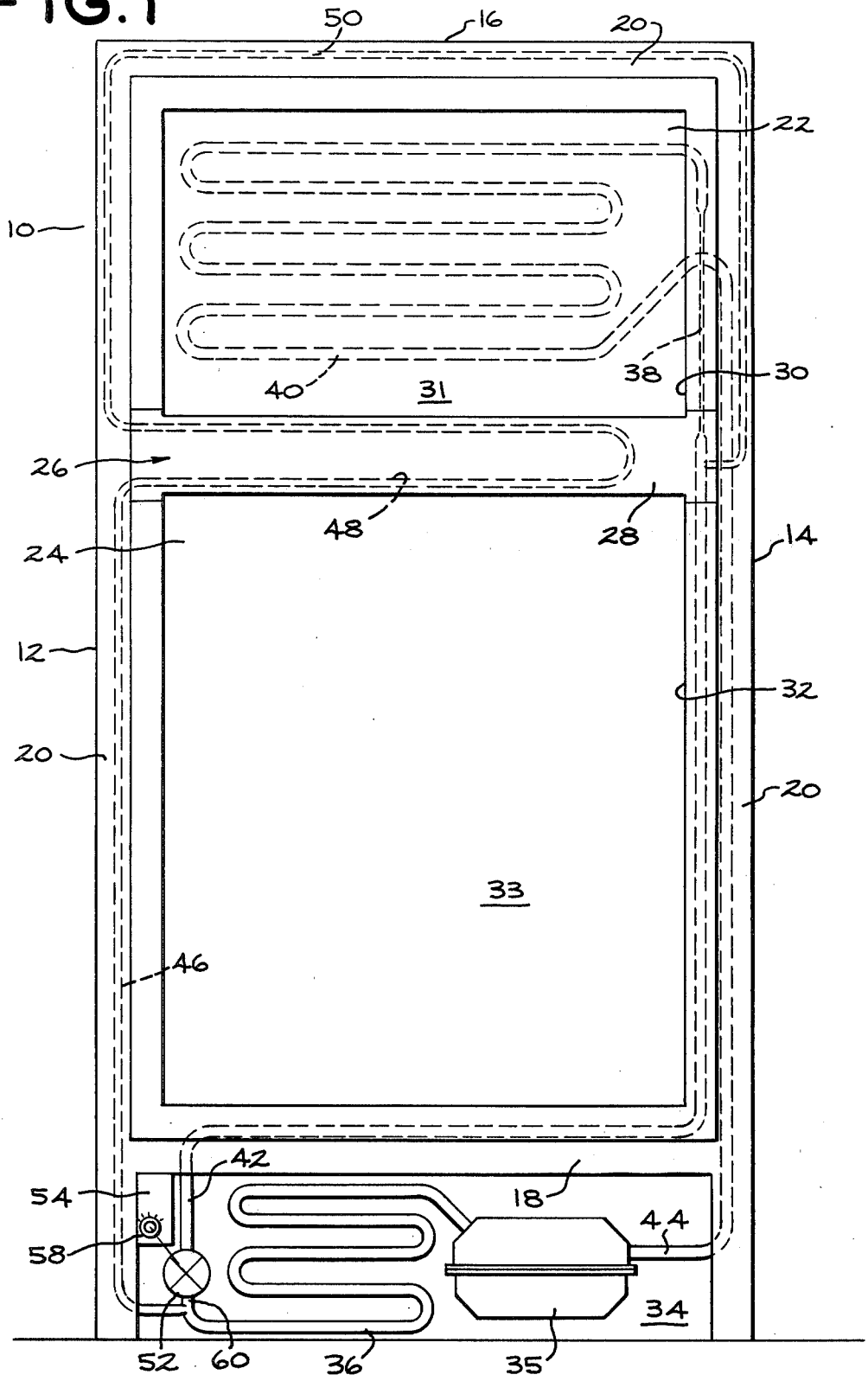
FIG. 1 is a schematic front elevational view of a refrigerator showing one embodiment of the invention.

Referring now to the drawings and more particularly to FIG. 1 there is shown schematically a refrigerator cabinet 10 having a continuous outer sheet metal U-shaped wall forming the sidewalls 12, 14 and top 16. A bottom wall portion 18 extending between the sidewalls 12, 14 define the outer walls of cabinet 10.

The sidewalls 12 and 14, and top wall 16 are reinforced at the front of the cabinet with a flange 20 extending inwardly substantially at right angles to the side and top walls. The cabinet 10 is divided between a freezer compartment 22 and a fresh food compartment 24 by a mullion 26. The mullion 26 includes a front face portion 28 that is secured at its longitudinal or outer ends to the flange formed on the sidewalls. The flange 20, together with the mullion front portion 28, defines the freezer door opening 30 for freezer compartment 31 and fresh food opening 32 for fresh food compartment 33.

A machine compartment 34 is provided below the bottom wall 18 of cabinet 10. In the present instance the refrigeration system compressor 35 and condenser 36 are shown arranged in compartment 34. The complete refrigeration system includes the compressor 35, condenser 36, an expansion device 38, an evaporator 40 all arranged in a manner for circuitous flow. Typically compressed refrigerant from the compressor 35 is directed to the condenser 36 in which refrigerant is condensed and liquid refrigerant then flows through liquid line 42. From the liquid line refrigerant passes through the expansion device 38 and into the evaporator 40 where refrigerant is evaporated by absorbing heat and then through suction line 44 back to the compressor.

In accordance with the present invention, the condensate control system includes an auxiliary liquid line 46 that is arranged in heat exchange relationship with the freezer door opening. More specifically, the auxiliary liquid line 46 extends from a point in the liquid line 42 to a first loop or return run portion 48 located in heat exchange relationship with the mullion front portion 28, and a second loop portion 50 arranged in heat exchange relationship with the portions of the front flange 20 that defines the freezer door opening 30 and then back at a location in the liquid line downstream from the first point, but upstream from the expansion device 38.

As mentioned hereinbefore, the use of auxiliary post condenser loops or, more specifically, a tube carrying relatively warm liquid refrigerant adjacent the mullion surface and the outer case flange identifying the freezer door opening has been used in controlling surface condensate. However, when the auxiliary loop is always in the normal refrigeration circuit, it supplies heat whenever the compressor is running regardless of the humidity conditions and whether condensation is present. In these instances, the application of the liquid line can deliver more heat for longer periods of time than is required for controlling condensation or the accumulation of moisture around the freezer door opening 30 during the low and normal ambient humidity conditions. This excess heat, due in part to the location of the auxiliary liquid line, results in heat leakage into the cabinet compartments which requires additional compressor run time. This additional run time consumes energy and cuts into the saving realized over the use of electric resistance heaters.

By the present invention, means are provided to allow liquid refrigerant to flow through the auxiliary loop only during high humidity ambients and accordingly the heat to be delivered by the loop is in response to need as indicated by the ambient humidity.

To this end, as shown in the embodiment of FIG. 1, a valve 52 is arranged in the liquid line 42 with the auxiliary liquid line or loop 46 described above connected into the liquid on the upstream and downstream side of valve 52. In this embodiment, when the valve 52 is in its open position, refrigerant will bypass the auxiliary loop 46 and refrigerant flow in the system will be in the normal manner as explained hereinabove. When the valve 52 is in its closed position, the warm liquid refrigerant will then flow through auxiliary line 46 which, by its heat exchange arrangement with flange 20 and mullion 28, effectively transfers heat to the freezer door opening 30.

Figure 2:
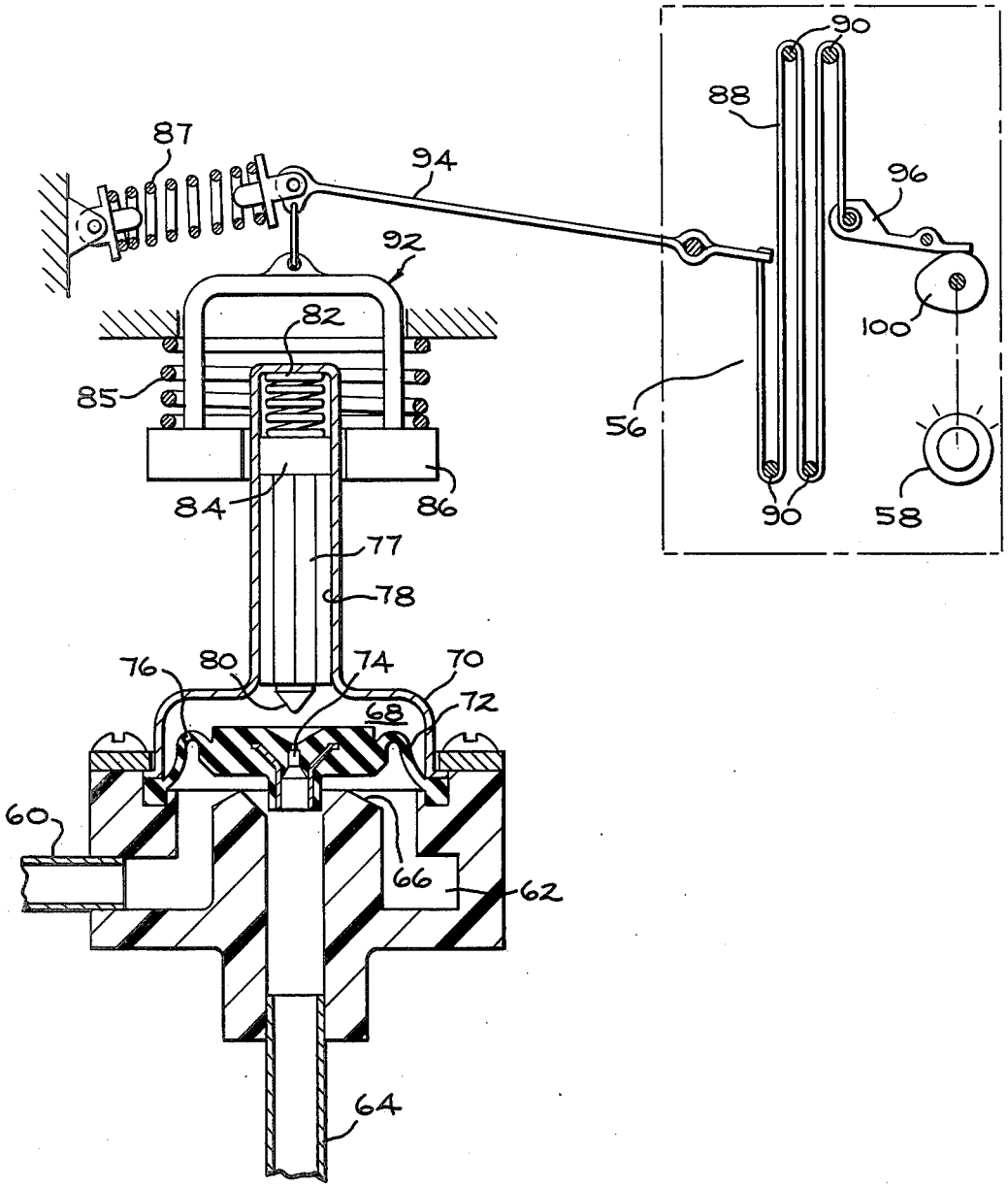
FIG. 2 is a schematic view of the control portion of the present invention.

In a typical installation of the invention, a control box 54 is shown mounted in the machine compartment 34 where it may be exposed to ambient conditions outside of the cabinet 10 compartments. It should be understood that the exact location of the valve 52 and control 54 is not critical and they may be arranged in any convenient location and manner. In accordance with the present invention of providing heat to the freezer door opening in response to high ambient humidity, a humidity sensor 56 is incorporated in the control box 54 and is schematically shown in FIG. 2. The control 54 may be provided with an adjustable knob 58 and a scale of index markings calibrated in percent relative humidity. Typically, the control might be set through knob 58 to a relative humidity of 55 percent. Normally, it would be adjusted to the highest relative humidity setting which maintains the freezer door opening free of undesirable moisture.

The valve 52, as employed in the present embodiment of the invention, may be of the type disclosed in Patent 3,768,771-Dicken, Jr. assigned to the General Electric Company, the assignee of the present invention. Referring to FIG. 2, the valve structure includes an inlet 60 for passing fluid into a passage 62 which communicates with an outlet 64. Passage 62 is provided with a valve seat 66. A chamber 68 is formed proximate the passage by an outer wall 70. Adjacent the valve seat 66, and between the valve seat and the chamber 68, is disposed a generally circular flexible diaphragm 72. The diaphragm being mounted to substantially isolate chamber 68 from passage 62. The diaphragm 72 is provided with a central aperture 74 and a second aperture 76 of a predetermined smaller diameter. A member 77 is arranged in a housing 78 for movement relative to the diaphragm 72. The member 77 includes a protrusion 80 at its lower end which is dimensioned to cooperate with and close off the central aperture 74 under action of a spring 82. While the member 77 in the Dicken, Jr. Patent forms the armature of a solenoid for moving member 77 relative to the diaphragm 72, the present invention modifies member 77 in the following manner.

Fixedly arranged on the upper portion of the member 77 is a magnet 84. A ring magnet is positioned to encircle magnet 84 in housing 78 and is dimensioned to move vertically relative thereto against action of spring 85 which biases the magnet downward and under the influence of spring 87 which imparts an over-center snap action. In operation as the ring magnet 86 is raised, snapping the magnet assembly to the position shown in FIG. 2 and compressing spring 85, it will move magnet 84 with it, thereby causing the member 77 to move upwardly. This action will withdraw protrusion 80 from the central aperture 74 and allow refrigerant flow between the inlet 60 and outlet 64. When the ring magnet 86 is lowered, it permits the member 77, under influence of spring 82, to reseat its protrusion 80 in the central aperture 74 and prevent refrigerant flow between inlet and outlet 64.

The humidistat or sensor 56, as employed in the present invention, controls movement of the ring magnet 86 and accordingly the flow of liquid refrigerant through the auxiliary loop 46.

The humidistat may include a humidity sensitive tape or strip 88. The strip 88 passes over a series of fixed rollers or supports 90 so that a designed length is provided. The tape is connected at one end to a yoke 92 through a lever 94. The yoke 92 in turn is connected to the ring magnet 86. The other end of the tape 88 is connected to one end of a lever or pivot 96. The other end of the lever is urged by the tension of the tape into engagement with a cam 100. The cam 100 is on a common shaft with a knob 58 which may be rotated to adjust the tension of strip 88 so that movement of ring magnet 86 and operation of valve 52 is in accordance with a selected humidity condition. During low humidity conditions, the strip is in its contracted mode and the yoke 92 and ring magnet 86 are in the raised position shown in FIG. 2 with the valve member 77 unseated and diaphragm 72 in its open position. With an increase in humidity the strip 88 will stretch causing the linkage to seat on the diaphragm aperture closing valve 52.

Figure 3:
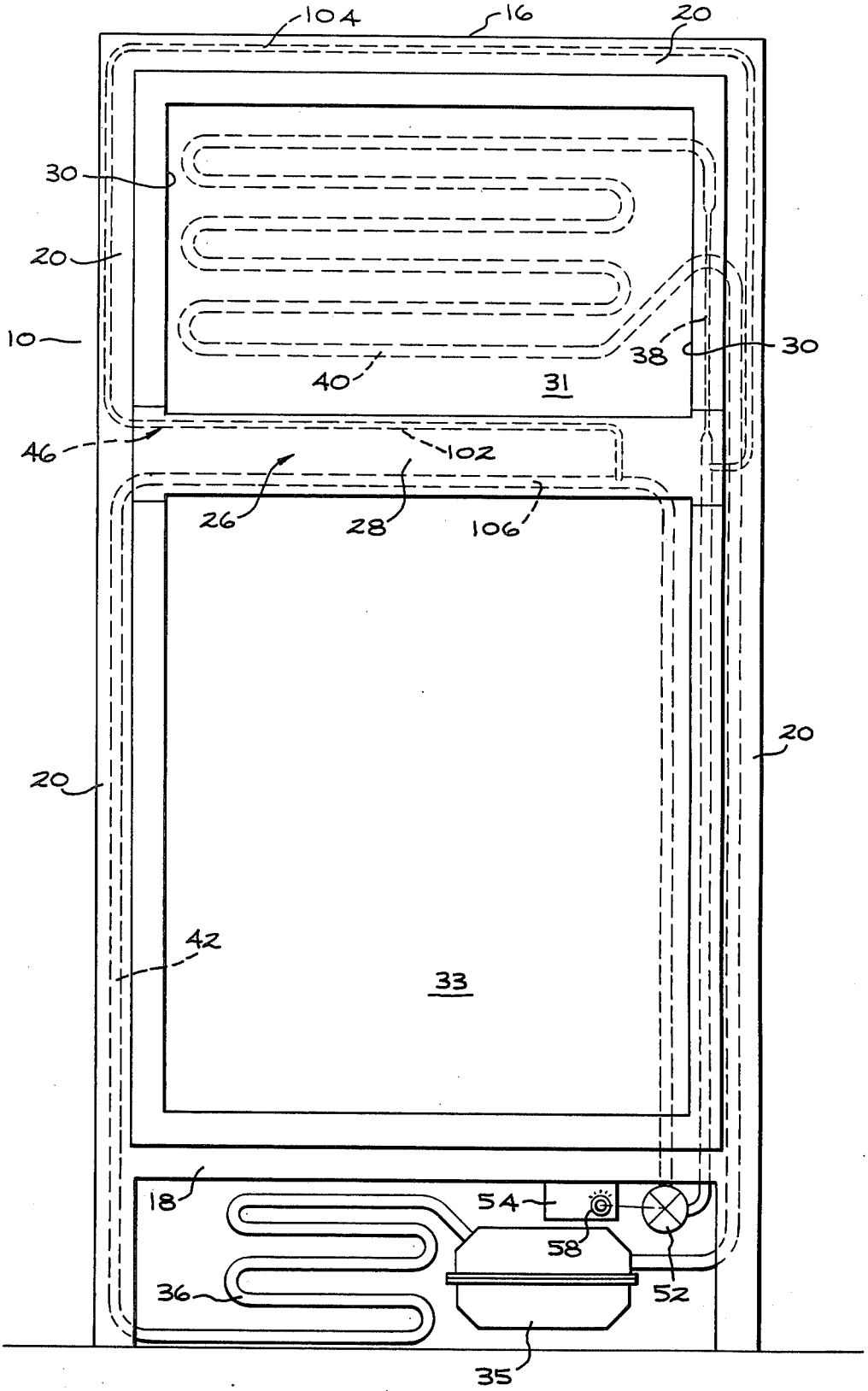
FIG. 3 is a schematic view similar to FIG. 1 showing a second embodiment of the invention.

In a second embodiment of the invention shown in FIG. 3, a modified arrangement of the auxiliary liquid line 46 is provided. In this modification, all parts similar to those of the embodiment of FIG. 1 are designated with the same reference numbers. Similar to the embodiment of FIG. 1, the auxiliary loop 46 is connected into the liquid line on the upstream and downstream side of valve 52. The auxiliary liquid line includes a first portion 102 located in heat exchange relationship with the mullion front portion 28 and a second portion 104 arranged in heat exchange relationship with the portion of the front flange 20 that defines the freezer door opening 30.

In this embodiment, a portion 106 of the refrigeration system liquid line 42 is arranged in heat exchange relationship with the front portion 28 of mullion 26. Accordingly, the portion 106 which is always in the refrigeration circuit supplies heat to the mullion 26 whenever the compressor is running. The portion 106 in this application is arranged and dimensioned to provide a constant amount of heat that is sufficient in preventing the formation of moisture in the mullion area during normal or borderline ambient humidity conditions while, at the same time, not generate an objectionable amount of heat leakage into the cabinet compartments. The closing of valve 52 and the application of heat by portions 102 and 104 of auxiliary line 46 while portion 106 is still effective in preventing the formation of condensation. The combination of heat application between the portion 106 of liquid line 42 and the auxiliary line 46 is effective in preventing condensation from forming.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. In a multi-compartment refrigerator cabinet defining a chamber, including a mullion dividing said chamber into a freezer and fresh food compartment, each having a front opening;

a refrigeration system for said cabinet including a compressor, a condenser, an expansion device and an evaporator arranged in series relation with the condenser being connected to the expansion device by a liquid refrigerant flow line;

valve means in said liquid flow line arranged intermediate said condenser and said expansion device;

an auxiliary liquid line connected in bypass relation to said valve means in said liquid refrigerant flow line, said auxiliary liquid line being connected into the liquid flow line in bypass relation with said valve between the condenser and expansion device, said auxiliary liquid line having a first portion arranged in said mullion and a second portion arranged in said freezer compartment front opening;

a control means including relative humidity sensing means for causing said valve to close when the relative humidity exceeds a predetermined level so that relatively warm liquid refrigerant will flow through said auxiliary liquid line to transfer heat to said mullion and said freezer compartment front opening.

2. The invention defined in claim 1 wherein said relative humidity sensing means is arranged outside said cabinet for sensing ambient relative humidity.

3. The invention defined in claim 2 wherein means associated with said sensing means for causing movement of said valve between its normally open to a closed position.

4. A multi-compartment refrigerator cabinet with a front opening including an outer sheet metal shell having top and sidewalls provided with an integral inturned flange at the front turned in substantially at a right angle to the top and sidewalls;

a mullion construction extending between said sidewall flanges with said mullion, said top wall flange and the portions of said sidewall flanges above said mullion defining a freezer front door opening, and said mullion and the portions of said sidewall flanges below said mullion defining a fresh food front door opening;

a refrigeration system for said cabinet including a compressor, a condenser, an expansion device and an evaporator arranged in series relation with the condenser being connected to the expansion device by a liquid refrigerant flow line;

valve means in said liquid flow line arranged intermediate said condenser and said expansion device;

an auxiliary liquid line connected in bypass relation to the said valve means in said liquid refrigerant flow line, said auxiliary liquid line being connected into the liquid flow line in bypass relation with said valve, between the condenser and expansion device, said auxiliary liquid line having a first portion arranged in said mullion and a second portion arranged in said top and sidewall flanges defining said freezer front door opening;

a control means including relative humidity sensing means for causing said valve to close when the relative humidity exceeds a predetermined level so that relatively warm liquid refrigerant will flow through said auxiliary liquid line to transfer heat to said flanges defining said freezer compartment front door opening.

5. The invention defined in claim 4 wherein said relative humidity sensing means is arranged outside said cabinet for sensing ambient relative humidity.

6. The invention defined in claim 5 wherein means associated with said sensing means for causing movement of said valve between its normally open to a closed position.

7. A multi-compartment refrigerator cabinet with a front opening including an outer sheet metal shell having top and sidewalls provided with an integral inturned flange at the front turned in substantially at a right angle to the top and sidewalls;

a mullion construction extending between said sidewall flanges with said mullion, said top wall flange and the portions of said sidewall flanges above said mullion defining a freezer front door opening, and said mullion and the portions of said sidewall flanges below said mullion defining a fresh food front door opening;

a refrigeration system for said cabinet including a compressor, a condenser, an expansion device and an evaporator arranged in series relation with the condenser being connected to the expansion device by a liquid refrigerant flow line, said liquid refrigerant line including a portion arranged in heat relationship with said mullion, valve means in said liquid flow line arranged intermediate said condenser and said expansion device;

an auxiliary liquid line connected in bypass relation to said valve means in said liquid refrigerant flow line, said auxiliary liquid line being connected into the liquid flow line in bypass relation to said valve means between said portion of said liquid line and said expansion device, said auxiliary liquid line having a first portion arranged in said mullion and a second portion arranged in said top and sidewall flanges defining said freezer front door opening;

a control means including relative humidity sensing means for causing said valve to close when the relative humidity exceeds a predetermined level so that relatively warm liquid refrigerant will flow through said auxiliary liquid line to transfer heat to said flanges defining said freezer compartment front door opening.

8. The invention defined in claim 7 wherein said relative humidity sensing means is arranged outside said cabinet for sensing ambient relative humidity.

9. The invention defined in claim 8 wherein means associated with said sensing means for causing movement of said valve between its normally open to a closed position.

* * * * *